US008459638B2

(12) United States Patent
Herrmann

(10) Patent No.: US 8,459,638 B2
(45) Date of Patent: Jun. 11, 2013

(54) ACTIVE DECURLER ADJUSTMENT USING ELECTRICALLY CONDUCTIVE PRESSURE ROLLERS

(75) Inventor: Douglas K. Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/218,622

(22) Filed: Aug. 26, 2011

(65) Prior Publication Data

US 2013/0049297 A1 Feb. 28, 2013

(51) Int. Cl.
*B65H 29/70* (2006.01)

(52) U.S. Cl.
USPC ..... 271/209; 271/188; 271/272; 271/273; 271/274

(58) Field of Classification Search
USPC ..... 271/272–274, 209, 188, 161; 399/406
See application file for complete search history.

(56) References Cited

U.S. PATENT DOCUMENTS 5,458,324 A 10/1995 Nakamura et al.
5,499,807 A 3/1996 Nakamura et al.
6,282,403 B1 8/2001 Spencer et al.
7,623,803 B2 * 11/2009 Carolan et al. ..... 399/67
2013/0001868 A1 * 1/2013 Herrmann ..... 271/188

FOREIGN PATENT DOCUMENTS

JP 55111337 A * 8/1980

* cited by examiner

*Primary Examiner* — Luis A Gonzalez
(74) *Attorney, Agent, or Firm* — Hoffmann & Baron, LLP

(57) ABSTRACT

A system and method for decurling a sheet medium including a first penetrating roller and a second elastomeric roller mounted substantially parallel. A pressure-sensitive electrically conductive material has properties that vary with its state of compression. An actuator is operative for moving the first penetrating roller and the second elastomeric roller in a direction towards each other, to penetrate the body of the second elastomeric roller with the body of the first penetrating roller. The pressure-sensitive electrically conductive material is subject to pressure by the penetration of the first penetrating roller into the second elastomeric roller. A pair of electrical terminals applies an electrical charge across the pressure-sensitive electrically conductive material. In further embodiments, an electrical property is substantially continuously measured and the depth of penetration is substantially continuously controlled based upon closed-loop feedback of the substantially continuously measuring.

20 Claims, 3 Drawing Sheets

ACTIVE DECURLER ADJUSTMENT USING ELECTRICALLY CONDUCTIVE PRESSURE ROLLERS

BACKGROUND

1. Field of the Disclosure

The present disclosure relates document creation. More specifically, the present disclosure is directed to a system and method for actively detecting the depth of penetration of a decurling roller 2. Brief Discussion of Related Art In a printer, substrate media, e.g., paper, vellum, etc., is often turned over rollers or drums, etc., for example to change direction of media transport in handling and/or to effect printing processes. Occasionally and to varying degrees, the media retains the shape of the bend, which is referred to as "curl". Curl is often detrimental to further handling and processes, and is undesirable in the finished document.

To address the problem of curl, U.S. Pat. No. 6,282,403 to Spencer, et al. ("Spencer"), hereby incorporated by reference, discloses a Decurler Roll Setup. The solution embodied in Spencer, e.g., is to pass the media over a decurling roller that has a radius in the opposite direction of the curl, to reverse the curl and result in a flatter media. For example, it is known from Spencer to use a pinch roller in conjunction with an opposing elastomeric roller, with the pinch roller penetrating the elastomeric roller and the media passing between the two rollers (Spencer, FIG. 2B). Accordingly, the elastomeric roller presses the media (sheet "S") over the pinch roller. Furthermore, in such an embodiment, the pinch roller has substantially smaller radius, as compared with both the radius of the curl exhibited in the media, and the opposing elastomeric roller.

In a decurling technique and apparatus as just disclosed by Spencer, the amount by which the media is to be decurled is variable, and is dependent upon the depth of penetration of the pinch roller into the elastomeric roller. Accordingly, the relative position of the two rollers must be controlled to a high degree of precision and accuracy. Accurately determining the relative position of the pinch and elastomeric decurling rollers in Spencer requires a relatively lengthy homing process (Spencer, FIG. 7), which slows cycle time and is a significant source of customer dissatisfaction.

Further, the process only infers the positions of the rollers by calculation. In order to calculate the position accurately, extremely tight tolerances in the mechanism are required, which increases build costs.

Lastly, one common and cost-effective method of locating the rollers is by use of a cam driven by a step motor. However, the failure to hold position of the cam under load is another source of error in decurling operation. Spencer does not provide real-time feedback of the relative positions between the pinch roller and the elastomeric roller. Therefore, an inadvertent shift of position by the step-motor driven locating system cannot be detected.

SUMMARY

In order to overcome these and other drawbacks in the present art, provided according to the present disclosure is a system for decurling a sheet medium including a first penetrating roller mounted for rotation around a first longitudinal axis and a second elastomeric roller mounted for rotation around a second longitudinal axis, the first and second longitudinal axes being substantially parallel with one another. The second elastomeric roller comprises a pressure-sensitive electrically conductive material which has electrically conductive properties that vary with its state of compression. An actuator is operative for moving one of the first penetrating roller and the second elastomeric roller in a direction transverse to the respective second or first longitudinal axis of the other, and to penetrate the body of the second elastomeric roller with the body of the first penetrating roller. The pressure-sensitive electrically conductive material is configured such that it is subject to pressure by the penetration of the first penetrating roller into the second elastomeric roller. A pair of electrical terminals is configured and operative to apply an electrical charge across the pressure-sensitive electrically conductive material.

The second elastomeric roller may optionally comprise an electrically conductive layer surrounding the pressure-sensitive electrically conductive material of the second elastomeric roller. At least one electrical terminal of the pair is held in contact with an outer surface of the elastomeric roller. In certain embodiments of the present disclosure, one electrical terminal is electrically connected with the first penetrating roller, and the second electrical terminal is electrically connected with the second elastomeric roller. The pair of electrical terminals may optionally be collectively arranged to apply the electrical charge axially or radially though the second elastomeric roller.

In certain embodiments of the present disclosure, the first penetrating roller has a hardness greater than the second elastomeric roller. In certain embodiments of the present disclosure, the first penetrating roller has a diameter smaller than the second elastomeric roller.

The actuator according to the present disclosure may comprise one or more cams configured and operative to act on a corresponding number of followers positioned on the respective first penetrating roller or second elastomeric roller. A motor may be configured and operative to rotate the one or more cams, the motor selected from the group comprising an electric step motor, an electric servo motor, and a fluid-powered motor.

Also provided according to the present disclosure is a method for decurling a sheet media includes feeding a sheet media between a first penetrating roller and a second elastomeric roller. The second elastomeric roller comprising a pressure-sensitive electrically conductive material which has electrically conductive properties that vary with its state of compression, wherein the body of the first penetrating roller penetrates the body of the second elastomeric roller. The pressure-sensitive electrically conductive material of the second elastomeric roller is configured such that it is subjected to pressure by the penetration of the first penetrating roller into the second elastomeric roller. An electrical property of the pressure-sensitive electrically conductive material is measured; and the depth of penetration of the first penetrating first roller into the second elastomeric roller is set based upon the measured electrical property.

In further embodiments of the presently disclosed method, an electrical property of the pressure-sensitive electrically conductive material is substantially continuously measured and the depth of penetration is substantially continuously controlled based upon closed-loop feedback of the substantially continuously measuring. Optionally, wear in the second elastomeric roller may be measured based upon the relative positions of the first penetrating roller and the second elastomeric roller.

In further embodiments of the presently disclosed method, setting the depth of penetration of the first penetrating first roller into the second elastomeric roller comprises operating an actuator operative for moving one of the first penetrating roller and the second elastomeric roller in a direction transverse to the respective second or first longitudinal axis of the other. The actuator may comprise one or more cams configured and operative to act on a corresponding number of followers positioned on the first penetrating roller or second elastomeric roller. A motor, selected from the group comprising an electric step motor, an electric servo motor, and a fluid-powered motor, may be configured and operative to rotate the one or more cams.

The presently disclosed method may optionally include applying an electrical charge across the pressure-sensitive electrically conductive material, for example in one of a radial or axial direction. The property measured may comprise the current or voltage of the applied electrical charge.

These and other purposes, goals and advantages of the present application will become apparent from the following detailed description of example embodiments read in connection with the accompanying drawings.

BRIEF DESCRIPTION OF THE DRAWINGS

Some embodiments are illustrated by way of example and not limitation in the figures of the accompanying drawings in which.

DETAILED DESCRIPTION

Introduction

As used herein, a "printer" refers to any device, machine, apparatus, and the like, for forming images on substrate media using ink, toner, and the like. A "printer" can encompass any apparatus, such as a copier, bookmaking machine, facsimile machine, multi-function machine, etc., which performs a print outputting function for any purpose. Where a monochrome printer is described, it will be appreciated that the disclosure can encompass a printing system that uses more than one color (e.g., red, blue, green, black, cyan, magenta, yellow, clear, etc.) ink or toner to form a multiple-color image on a substrate media.

As used herein, "substrate media" refers to a tangible medium, such as paper (e.g., a sheet of paper, a long web of paper, a ream of paper, etc.), transparencies, parchment, film, fabric, plastic, paperboard up to between about 26 and 29 point (i.e., about 0.026-0.029 in. thickness) or other substrates on which an image can be printed or disposed.

Description

Figure 1:
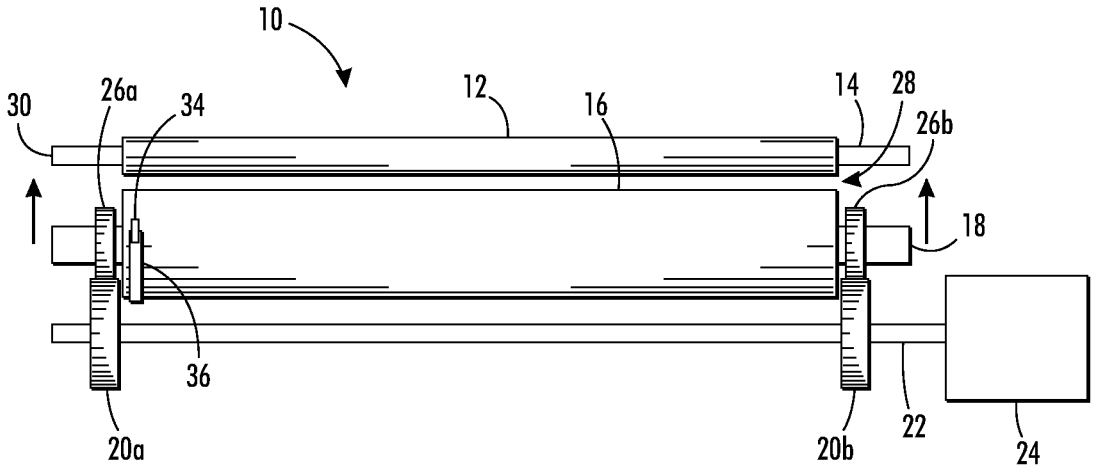
FIG. 1 illustrates a front elevation view of a decurler system according to an embodiment of the present disclosure, having a penetrating roll and a decurling roll disengaged from one another.
Figure 2:
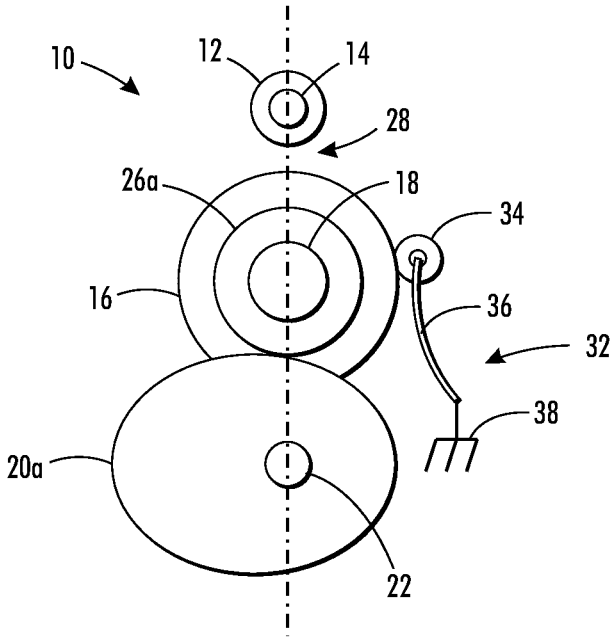
FIG. 2 illustrates an end elevation view of the decurler system depicted in FIG. 1.

Referring now to FIGS. 1 & 2, illustrated is an active decurler adjustment system, generally 10, according to an embodiment of the present disclosure, in front and side elevations views, respectively. A penetrating roll 12 is mounted on an axle 14, for example a prismatic spline, and is rotatable with the axle 14 around a longitudinal axis. The axle 14 is driven by a motor or the like (not shown). An opposing elastomeric roller 16 is mounted on an axle 18, which may also be a prismatic spline, and is likewise rotatable with the axle 18 around a longitudinal axis. Elastomeric roller 16 and axle 18 are further optionally driven by a motor or the like (not shown) instead of or in addition to a rotational force driving the axle 14 of the penetrating roll 12.

The axle 18 is mounted to translate in a direction transverse to the axis of the penetrating roll 12, in this case vertically, to bring the elastomeric roll 16 into engagement with the penetrating roll 12. In one embodiment, one or more cams 20*a*, 20*b* are mounted on an axle 22, for example a prismatic spline, and rotate with the axle 22. The axle 22 is in turn driven by a actuator 24, in this example a stepper motor, to position and hold the cams 20*a*, 20*b*, which act on the axle 18 through cam followers 26*a*, 26*b*, formed thereon, which are in this case embodied as collars on the axle 18. Alternately or additionally, the motor may comprise a servo motor, or a hybrid motor, or a fluid-powered motor. It will also be appreciated that optionally the cams may be moved linearly rather than or in addition to rotationally. Within the range of motion of the elastomeric roll 16, and space 28 may be formed to admit a substrate media, for example a cut sheet of paper. The space 28 may be closed to the penetrating roller 12 penetrates the body of the elastomeric roller 16, as illustrated, for example, in FIGS. 3-5, described further below.

It will be appreciated by those skilled in the art and in light of the instant disclosure that the penetrating roll 12 may be moved into or out of engagement with the elastomeric roll 16 rather than, or in addition to, the motion of the elastomeric roll 16 as previously described. The apparatus effecting the motion of the penetrating roll 12 may be similar to that described above with respect to the elastomeric roll 16, or either or both may be substituted by those known in the art without departing from the scope of the present disclosure.

Figure 3:
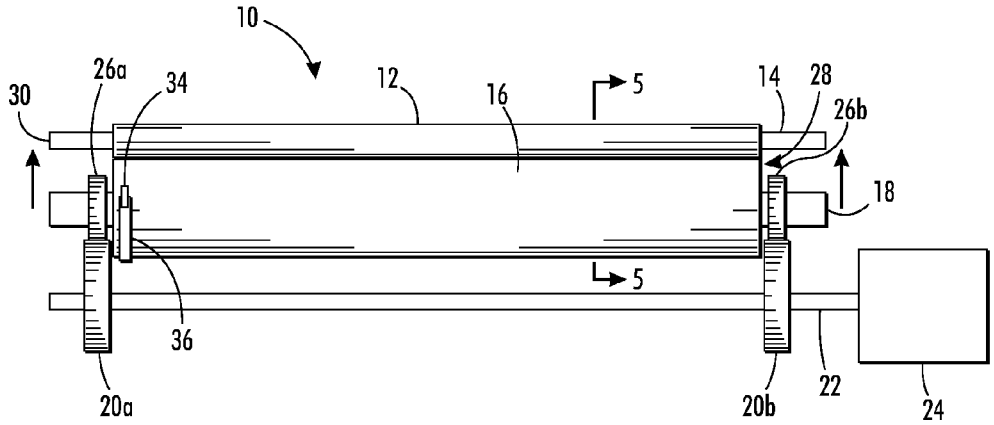
FIG. 3 illustrates a front elevation view of a decurler system according to an embodiment of the present disclosure, having a penetrating roll and a decurling roll engaged with one another.
Figure 4:
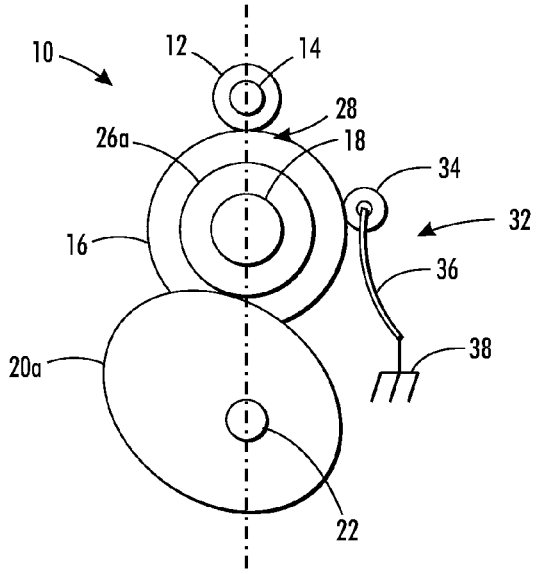
FIG. 4 illustrates an end elevation view of the decurler system depicted in FIG. 3.

Referring now to FIGS. 3 and 4, illustrated is the active decurler adjustment system 10, showing the penetrating roll 12 engaged with the elastomeric roll 16. As illustrated in FIGS. 3 & 4, the actuator 24 rotates axle 22 and therewith cams 20*a*, 20*b*, which act on followers 26*a*, 26*b*, respectively. Axle 18 and elastomeric roller 16 is thereby moved towards axle 14 and penetrating roll 12.

According to the present embodiment, the elastomeric roll 16 has electric properties which vary with its state of compression. A pressure-sensitive and electrically conductive roller is disclosed, for example, in U.S. Pat. No. 5,458,324 to Nakamura, et al. ("Nakamura '324") or U.S. Pat. No. 5,499,807, also to Nakamura, et al. ("Nakamura '807"), the complete disclosures of which are hereby incorporated by reference for all purposes. Generally speaking, the electrical characteristics of the pressure-sensitive roller vary according to its state of compression. In one embodiment, a voltage is applied to the axle 14, for example at a terminal 30, in which case the axle 14 would comprise an electrically conductive material. A current would be generated in the axle 14, pass through the penetrating roll 12, also electrically conductive, into the elastomeric roll 16. This arrangement presumes an area of electrical conductivity between the penetrating roll 12 and the elastomeric roll 16, for example in an area of contact between the two outside the borders of the sheet media passing between them for decurling, or else through the sheet media depending upon its electrical properties of conductivity or resistivity.

The current flowing from is directed through a pickup 32, which is electrically connected with a neutral voltage 38. The pickup 32 may include a roller 34 and a spring 36 to bias the roller 34 against the elastomeric roll 16, in order to maintain contact with the roller and thus an electrical circuit from the terminal 30 to the pickup 32. The current induced by the voltage can be sensed, and changes in the current that result with changes to the state of compression of the elastomeric roll 16 can be detected. Changes in this flow of current can be calibrated to represent the corresponding depth of penetration of the penetrating roll 12 into the elastomeric roll 16.

Alternately, a voltage may be applied axially across the elastomeric roll 16, i.e., from one axial end thereof to the other, for example by a duplicate follower 32 placed at the opposite axial end. The resulting current induced through the elastomeric roll will show variation with the state of compression of the elastomeric roll 16. In that case, it may be beneficial to avoid any short circuit or parallel path, for example through the axle 18. Alternately, a sensing voltage may be applied radially across the elastomeric roll 16, for example between a follower 32 and the axle 18. Moreover, follower 32 may be replaced or supplemented by a brush or the like.

Figure 5:
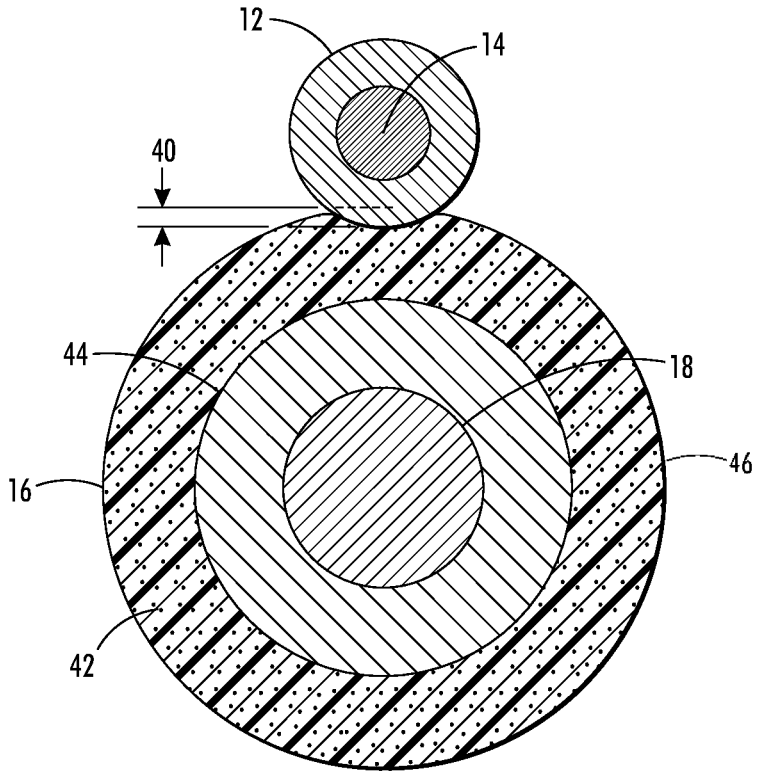
FIG. 5 illustrate an axial cross-section taken along line 5-5 of FIG. 3.

FIG. 5 illustrates a detailed view of the penetrating roll 12 engaged with the elastomeric roll 16. The depth of penetration of the penetrating roll 12 into the elastomeric roll 16 is indicated at dimension lines 40. In FIG. 5, the elastomeric roll 16 is shown in one optional configuration having an electrically-conductive pressure-sensitive outer cylinder 42 surrounds an inner core 44, radially inward from the outer cylinder 42. Both are mounted together on and rotate with the axle 18. The elastomeric roller 16 may further optionally include an outer conductive layer 46 to evenly distribute an applied electrical current or voltage across its surface. The electrical properties of the outer cylinder 42 are modeled schematically as a plurality of resistors, R1, R2, R3, R4, R5. The properties of the electrically-conductive pressure-sensitive material comprised in the outer cylinder 42 are such that the change in compression alters the resistivity of the material. This change in resistivity is measurable by detecting the change in voltage drop across the electrically-conductive pressure-sensitive material exhibited in a test current, as the electrically-conductive pressure-sensitive material is subjected to varying degrees of compression.

The system and methods according to the present disclosure have several advantages. Among these, the depth of penetration of the penetrating roll 12 into the elastomeric roll 16 may be directly measured, not merely inferred. Therefore, the system is more accommodating of wider tolerances in manufacturing, and thus manufacturing costs are less. Because the depth of penetration of the penetrating roll 12 into the elastomeric roll 16 is directly measured, it can be monitored in real-time during a decurling operation and controlled in a closed-loop manner based upon the measurement feedback. Any error, for example imparted by inadvertent slippage of the actuator 24 driving the cam axle 22, can be immediately detected and corrected.

The system according to applicant's instant disclosure is also substantially immune to the effects of wear in either roll 12 or 16, but mostly elastomeric roll 16. Because the depth of penetration is measured as electrical changes dependent upon the state of compression, to the extent that the elastomeric roll 16 diameter is reduced in service due to wear, the relative position of the rolls 12, 16 are simply adjusted until a necessary depth of penetration is achieved, which directly correlates with the decurl characteristics imparted to the media. Moreover, by sensing for changes to the electrical current applied across the elastomeric roll 16 during the positioning of the roll 16 by the actuator 24, the presence and amount of any wear of the elastomeric roll 16 can be detected.

Because the interface of the penetrating roll 12 into the elastomeric roll 16 is directly detected through changes in the electrical properties of the elastomeric roll 16, the manner of positioning a penetrating roll 12 and an elastomeric roll 16 according to the present disclosure further eliminates the need for a preliminary homing operation to infer its position. This, in turn, improves (by shortening) the initialization and start-up times of a printer implementing such a system.

It will be appreciated by those skilled in the art that certain alterations or modifications of the system and methods of the present disclosure, including their features and functions, or alternatives thereof, may be apparent. The same may be desirably combined into many other different systems or applications. The systems and methods disclosed are offered as merely exemplary of, and not liming on, the scope of the present disclosure. Various presently unforeseen or unanticipated alternatives, modifications, variations, or improvements therein may be subsequently made by those skilled in the art which are also intended to be encompassed by the following claims.

I claim:

1. A system for decurling a sheet medium comprising:

a first penetrating roller mounted for rotation around a first longitudinal axis thereof;

a second elastomeric roller mounted for rotation around a second longitudinal axis thereof, the first and second longitudinal axes being substantially parallel with one another, the second elastomeric roller comprising a pressure-sensitive electrically conductive material which has electrically conductive properties that vary with its state of compression;

an actuator operative for moving one of the first penetrating roller and the second elastomeric roller in a direction transverse to the respective second or first longitudinal axis of the other, and to penetrate the body of the second elastomeric roller with the body of the first penetrating roller;

the pressure-sensitive electrically conductive material configured such that it is subject to pressure by the penetration of the first penetrating roller into the second elastomeric roller; and first and second electrical terminals configured and operative to apply an electrical charge across the pressure-sensitive electrically conductive material.

2. The system for decurling a sheet medium according to claim 1, further comprising an electrically conductive layer surrounding the pressure-sensitive electrically conductive material of the second elastomeric roller.

3. The system for decurling a sheet medium according to claim 1, wherein the first electrical terminal is held in contact with an outer surface of the elastomeric roller.

4. The system for decurling a sheet medium according to claim 1, wherein the first and second electrical terminals are collectively arranged to apply the electrical charge radially though the second elastomeric roller.

5. The system for decurling a sheet medium according to claim 1, wherein the first and second electrical terminals are collectively arranged to apply the electrical charge axially though the second elastomeric roller.

6. The system for decurling a sheet medium according to claim 1, wherein the first penetrating roller has a hardness greater than the second elastomeric roller.

7. The system for decurling a sheet medium according to claim 1, wherein the first penetrating roller has a diameter smaller than the second elastomeric roller.

8. The system for decurling a sheet medium according to claim 1, wherein the actuator comprises one or more cams configured and operative to act on a corresponding number of followers positioned on the respective first penetrating roller or second elastomeric roller.

9. The system for decurling a sheet medium according to claim 8, further comprising a motor configured and operative to rotate the one or more cams, the motor selected from the group comprising an electric step motor, an electric servo motor, and a fluid-powered motor.

10. A system for decurling a sheet medium comprising:

a first penetrating roller mounted for rotation around a first longitudinal axis thereof;

a second elastomeric roller mounted for rotation around a second longitudinal axis thereof, the first and second longitudinal axes being substantially parallel with one another, the second elastomeric roller comprising a pressure-sensitive electrically conductive material which has electrically conductive properties that vary with its state of compression;

an actuator operative for moving one of the first penetrating roller and the second elastomeric roller in a direction transverse to the respective second or first longitudinal axis of the other, and to penetrate the body of the second elastomeric roller with the body of the first penetrating roller;

the pressure-sensitive electrically conductive material configured such that it is subject to pressure by the penetration of the first penetrating roller into the second elastomeric roller; and first and second electrical terminals configured and operative to apply an electrical charge across the pressure-sensitive electrically conductive material, wherein the first electrical terminal is electrically connected with the first penetrating roller, and the second electrical terminal is electrically connected with the second elastomeric roller.

11. A method for decurling a sheet media comprising:

feeding a sheet media between a first penetrating roller and a second elastomeric roller, the second elastomeric roller comprising a pressure-sensitive electrically conductive material which has electrically conductive properties that vary with its state of compression, wherein the body of the first penetrating roller penetrates the body of the second elastomeric roller, the pressure-sensitive electrically conductive material of the second elastomeric roller configured such that it is subjected to pressure by the penetration of the first penetrating roller into the second elastomeric roller;

measuring an electrical property of the pressure-sensitive electrically conductive material; and setting the depth of penetration of the first penetrating roller into the second elastomeric roller based upon the measured electrical property.

12. The method for decurling a sheet media according to claim 11, wherein setting the depth of penetration of the first penetrating roller into the second elastomeric roller comprises operating an actuator operative for moving one of the first penetrating roller and the second elastomeric roller in a direction transverse to the respective second or first longitudinal axis of the other.

13. The method for decurling a sheet media according to claim 12, wherein the actuator comprises one or more cams configured and operative to act on a corresponding number of followers positioned on the first penetrating roller or second elastomeric roller.

14. The method for decurling a sheet media according to claim 12, further comprising operating a motor selected from the group comprising an electric step motor, an electric servo motor, and a fluid-powered motor, the motor being configured and operative to rotate the one or more cams.

15. The method for decurling a sheet media according to claim 11, further comprising applying an electrical charge across the pressure-sensitive electrically conductive material.

16. The method for decurling a sheet media according to claim 15, further comprising applying an electrical charge across the pressure-sensitive electrically conductive material in a radial direction of the second elastomeric roller.

17. The method for decurling a sheet media according to claim 15, further comprising applying an electrical charge across the pressure-sensitive electrically conductive material in a axial direction of the second elastomeric roller.

18. The method for decurling a sheet media according to claim 15, wherein measuring an electrical property of the pressure-sensitive electrically conductive material comprises measuring the current or voltage of the applied electrical charge applied across the pressure-sensitive electrically conductive material of the second elastomeric roller.

19. A method for decurling a sheet media comprising:

feeding a sheet media between a first penetrating roller and a second elastomeric roller, the second elastomeric roller comprising a pressure-sensitive electrically conductive material which has electrically conductive properties that vary with its state of compression, wherein the body of the first penetrating roller penetrates the body of the second elastomeric roller, the pressure-sensitive electrically conductive material of the second elastomeric roller configured such that it is subjected to pressure by the penetration of the first penetrating roller into the second elastomeric roller;

measuring an electrical property of the pressure-sensitive electrically conductive material; and setting the depth of penetration of the first penetrating roller into the second elastomeric roller based upon the measured electrical property, wherein measuring an electrical property of the pressure-sensitive electrically conductive material comprises substantially continuously measuring the electrical property and setting the depth of penetration comprises substantially continuously controlling the depth of penetration based upon the closed-loop feedback of the substantially continuous measuring.

20. A method for decurling a sheet media comprising:

feeding a sheet media between a first penetrating roller and a second elastomeric roller, the second elastomeric roller comprising a pressure-sensitive electrically conductive material which has electrically conductive properties that vary with its state of compression, wherein the body of the first penetrating roller penetrates the body of the second elastomeric roller, the pressure-sensitive electrically conductive material of the second elastomeric roller configured such that it is subjected to pressure by the penetration of the first penetrating roller into the second elastomeric roller;

measuring an electrical property of the pressure-sensitive electrically conductive material;

setting the depth of penetration of the first penetrating roller into the second elastomeric roller based upon the measured electrical property; and measuring for wear in the second elastomeric roller based upon the relative positions of the first penetrating roller and the second elastomeric roller.

* * * * *